US006666282B2

(12) United States Patent
Merrick

(10) Patent No.: US 6,666,282 B2
(45) Date of Patent: Dec. 23, 2003

(54) IMPACT TOOL CARRIAGE SYSTEM

(76) Inventor: Jake Merrick, 801 N. Broadway, Hinton, OK (US) 73047

( * ) Notice: Subject to any disclaimer, the term of this patent is extended or adjusted under 35 U.S.C. 154(b) by 0 days.

(21) Appl. No.: 10/206,142

(22) Filed: Jul. 26, 2002

(65) Prior Publication Data

US 2003/0047332 A1 Mar. 13, 2003

Related U.S. Application Data

(60) Provisional application No. 60/308,364, filed on Jul. 26, 2001.

(51) Int. Cl.[7] ..... E21B 23/10

(52) U.S. Cl. ..... 173/31; 173/32; 173/33; 173/37

(58) Field of Search ..... 173/31, 32, 33, 173/34, 36, 37, 39, 141; 408/136, 235, 236

(56) References Cited

U.S. PATENT DOCUMENTS 1,674,669 A * 6/1928 Stedman ..... 408/235
1,832,101 A * 11/1931 Decker ..... 81/57.4
2,242,293 A * 5/1941 Eden et al. ..... 408/10
2,439,965 A * 4/1948 Cupler ..... 408/89
2,810,308 A * 10/1957 Bodmer ..... 408/136
2,868,043 A * 1/1959 Robbins ..... 408/135
3,068,722 A * 12/1962 Carion
3,552,239 A * 1/1971 Yeaman et al. ..... 408/146
3,771,896 A * 11/1973 Witzig et al. ..... 408/237
4,582,456 A * 4/1986 Imai ..... 408/136
4,780,030 A * 10/1988 Zudall ..... 408/88
5,244,048 A * 9/1993 Moorhead, Sr. ..... 173/141
5,346,337 A * 9/1994 Truesdell ..... 408/1 R

* cited by examiner

*Primary Examiner*—Rinaldi I. Rada
*Assistant Examiner*—Nathaniel Chukwurah
(74) *Attorney, Agent, or Firm*—Bracewell & Patterson LLP

(57) ABSTRACT

A carriage system supports an impact or driver tool. The carriage system has a support member that extends upwardly from a base platform. Support arms are rotatably connected to the support member at medial portion of the arms at different elevations above the support member. A proximal end of each of the arms rotatably connects to a weight, while a distal end of each of the arms is adapted to rotatably connect to the driver tool. The weight is located on an opposite side of the support member from the driver tool when the driver tool is attached. When the weight is moved in a vertical direction, the arms rotate in combination with the movement of the weight. The arms rotate about their respective medial connections, thereby forcing the ends that rotatably connect to the driver tool to move in a vertically opposite direction than the weight.

1 Claim, 4 Drawing Sheets

IMPACT TOOL CARRIAGE SYSTEM

Applicant claims priority to the application described herein through a United States provisional patent application entitled "Impact Tool Carriage System, having U.S. patent application Ser. No. 60/308,364 which was filed on Jul. 26, 2001.

TECHNICAL FIELD

This device relates in general to devices for unscrewing threaded members, and in particular to a carriage that will support and position an impact tool while the tool is being used to remove a threaded stud or a nut.

BACKGROUND of the INVENTION

Pneumatic tools can be cumbersome and difficult to operate in certain conditions. Some pneumatic driver tools or impact tools that are typically used for unscrewing threaded members can be heavy and require one or more persons to use both hands to support the tool when trying to remove threaded members that are above the person. This does not allow a person to easily control how the driver tool is engaging the threaded member.

What is needed is an apparatus that can support a driver tool so that the person operating the tool can focus on how the tool is engaging the threaded member rather that balancing the tool. The apparatus needs to be maneuverable so that operator can efficiently remove threaded members that are located at different locations. The apparatus needs to be able to help lift the driver tool into position before the operator operates the driver tool.

SUMMARY OF THE INVENTION

A carriage system adapted to support a driver tool. The system for supporting the driving tool has at least one support member with a lower portion connected to a horizontally extending platform with other portions of the support member extending upwardly from the platform. A first arm is rotatably connected to the support member at a first elevation above the platform. The connection of the first arm to the support member is at a medial portion of the first arm. A distal end of the first arm defines a first driver end and a proximal end of the first arm defines a first weight end. A distal portion of the first arm adjacent the first driver end is adapted to rotatably engage a first portion of a driver tool.

A second arm is rotatably connected to the support member at a second elevation that is closer to the platform than the first elevation. The connection of the second arm to the support member is at a medial portion of the second arm. A distal end of the second arm defines a second driver end and a proximal end of the second arm defines a second weight end. A distal portion of the second arm adjacent the second driver end is adapted to rotatably engage a second portion of the driver tool.

A weight is positioned between the first weight end of the first arm and the second weight end of the second arm. A portion of the first arm toward the first weight end is rotatably connected to an upper elevation of the weight and a portion of the second arm toward the second weight end is rotatably connected to a lower elevation of the weight. When the weight and the first weight end and the second weight end vertically move in combination in a first direction the first driver end and second driver end move in combination in a vertically opposite second direction.

DETAILED DESCRIPTION OF THE DRAWINGS

Figure 1:
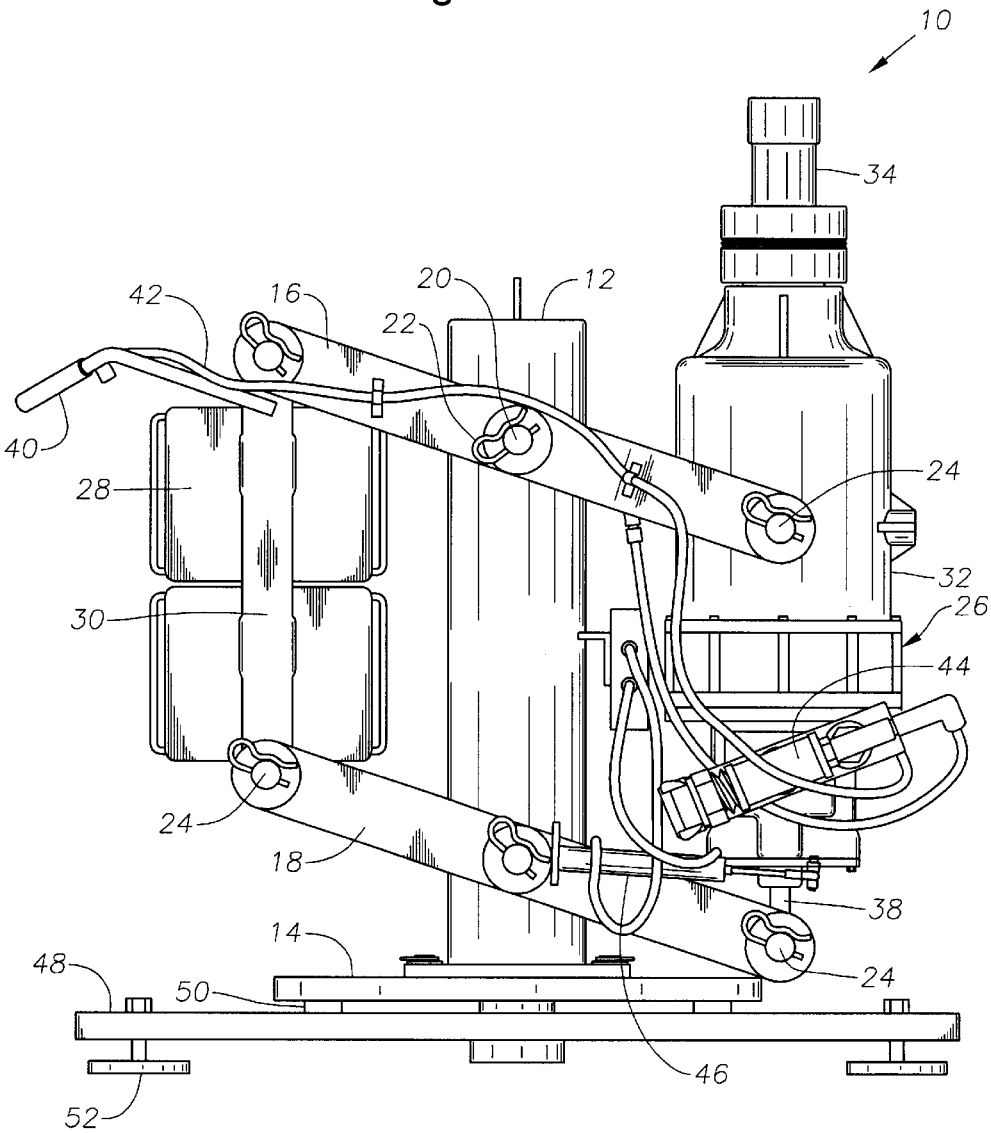
FIG. 1 is a side view of a carriage system constructed in accordance with this invention, shown with the tool driver in the lowered position.
Figure 2:
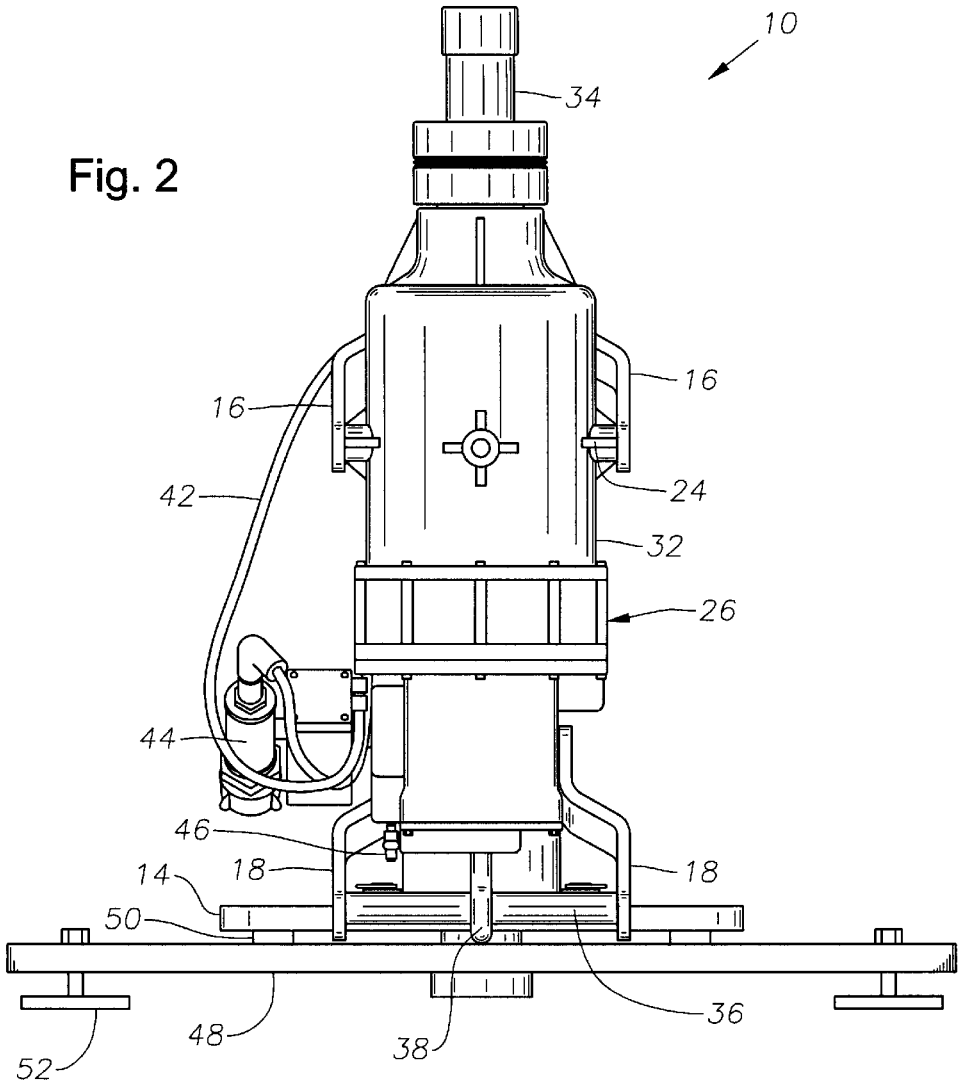
FIG. 2 is a front view of the apparatus of FIG. 1.

FIGS. 1 and 2 show a carriage system 10 constructed in accordance with the invention. Carriage system 10 comprises a support member such as a vertical, cylindrical pillar 12 which is securely fastened to a base 14, which is a circular plate. A pair of upper arms 16 and a pair of lower arms 18 are attached at their midpoints to the pillar 12 by pivot pins 20, so that each upper arm 16 and lower arm 18 is free to rotate about its midpoint in a vertical plane with respect to pillar 12. Each pivot pin 20 has a transverse hole (not shown) at the end, through which passes a locking pin 22 to hold the pivot pin 20 securely in place relative to the arm. Each upper arm 16 and lower arm 18 is substantially rectangular in cross-section, with all four arms having essentially identical dimensions. Upper arms 16 are parallel to each other and to both lower arms 18.

Hinge pins 24 at both ends of each upper arm 16 and lower arm 18 allow for the attachment of a tool driver 26 at one end of the arms, and the attachment of counterweights 28 at the opposite end of the arms relative to the pillar 12. Counterweights 28 are mounted to vertical braces 30 that extend between arms 16, 18 and are connected by hinge pins 24. Each of these hinge pins 24 also has a locking pin at its end as described above.

Tool driver 26 is a pneumatic powered driver or impact tool of a type well known to those skilled in the art. Tool driver 26 has a body 32 which is attached to one end of each upper arm 16 and lower arm 18 by hinge pins 24 as described above. Tool driver 26 also has a square or multi-sided drive head 34 for receiving and securely holding a socket (not shown) for gripping a threaded fastener. Socket may be configured to grip a threaded stud, a nut, or an Allen head. As shown in FIG. 2, a bar 36 extends between the forward ends of lower arms 18. Bar 36 passes through a ring 38 located at the lower end of tool driver body 32. Ring 38 transfers torque on the housing of tool driver 26 to bar 36, hinge pin 24, arms 18, and pillar 12.

Counterweights 28 are attached to the opposite end of each upper arm 16 and lower arm 18. Counterweights 28 have a total weight approximately equal to or slightly less than that of tool driver 26. The distance between counterweights 28 and pillar 12 is roughly equivalent to the distance between tool driver 26 and pillar 12.

A handle 40 secured to each brace 30 extends from counterweights 28 away from pillar 12, in a direction substantially parallel to upper arms 16. Control lines 42 extend from handle 40, along upper arm 16, to control valve 44 on tool driver 26 to allow an operator to control the operation of tool driver 26. A pneumatic piston 46 is positioned between the pivot pin 20 at the midpoint of lower arm 18 and a point on the lower surface of tool driver 26 to permit the operator to change between clockwise and counterclockwise movement. Piston 46 is operated by a control device mounted on one of the handles 40.

In the preferred embodiment of the invention, base 14 is mounted on a platform 48 by a plurality of bearings 50 to enable pillar 12 to be rotated relative to platform 48. Platform 48 is circular or rectangular. A plurality of feet 52 are mounted at the periphery of platform 48. Feet 52 are sufficiently broad to provide a stable support for the carriage system 10. Casters (not shown) engage the floor to allow carriage 10 to be rolled from one location to another. Feet 52 are vertically adjustable to lift the casters above the floor while carriage system 10 is operating.

Figure 3:
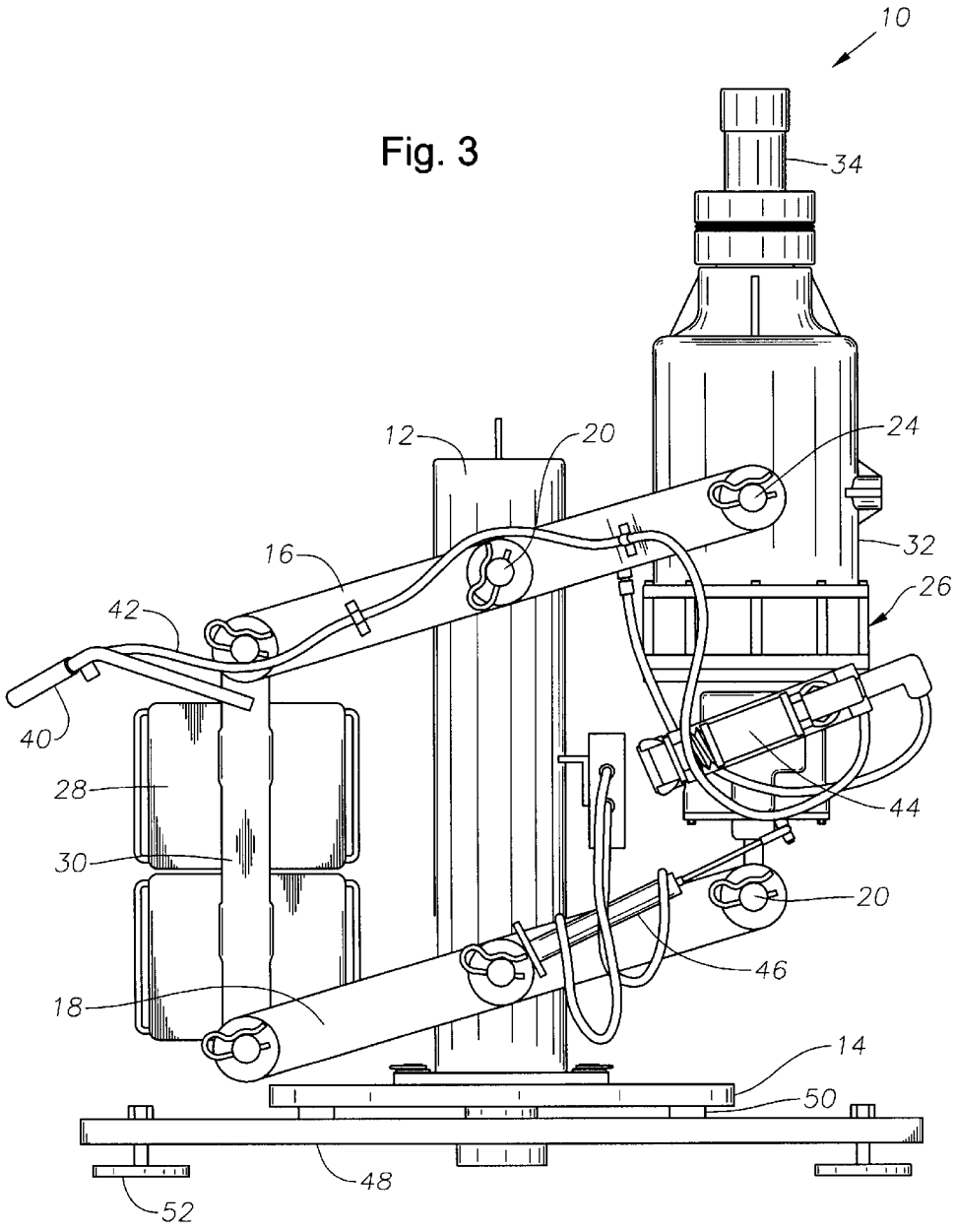
FIG. 3 is a side view of the apparatus of FIG. 1, shown with the tool driver in the elevated position.

In operation, the carriage system 10 begins in the position illustrated in FIG. 1, with the tool driver 26 in the lowered position. A fastener engaging tool (not shown) is installed on the drive head 34 of tool driver 26. The carriage system 10 is then positioned so that tool driver 26 is generally below the stud or nut to be loosened. An operator manually pushes the handles 40 downward. Upper arms 16 and lower arms 18 will rotate about their midpoints at pivot pins 20, counterweights 28 will move downward, and tool driver 26 will move upward to the elevated position shown in FIG. 3. Braces 30 link both upper arms 16 and lower arms 18 together at one end, and tool driver 26 links the arms at their other end, so that all four arms are constrained to move in unison. This unified motion ensures that tool driver 26 will remain vertical while moving from the lowered position to the elevated position.

When tool driver 26 reaches the desired elevation, socket or gripping tool on drive head 34 engages the fastener. The operator uses the controls mounted on handle 40 to rotate drive head 34 and the socket. After the completion of the task at hand, the operator will raise the handles 40, returning tool driver 26 to the lowered position. The socket or gripping tool can then be removed from tool driver 26, or the carriage system 10 can be moved to a different location to perform further work.

Figure 4:
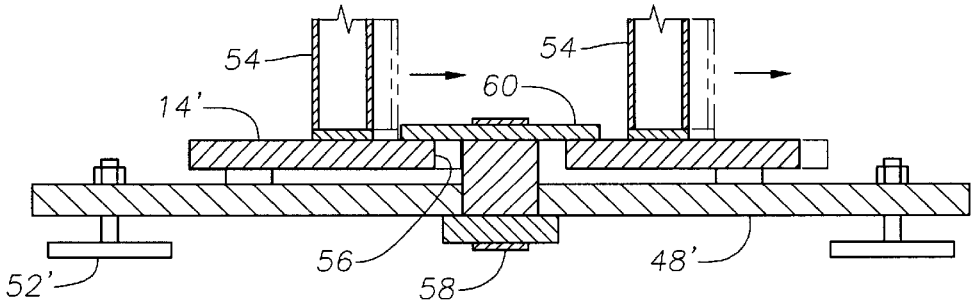
FIG. 4 is a detailed front view of the lower portion of an alternate embodiment of the invention.

FIG. 4 illustrates an alternate embodiment of the carriage system of the invention. In this alternate embodiment, the support member that was pillar 12 in the other embodiment is replaced with two vertical, rectangular support columns 54 as another example of a pair of support members. Columns 54 are securely attached to base 14', which has a circular hole 56 in the center. Anchor bolt 58 extends up through platform 48' and through hole 56. Retainer plate 60 prevents bolt 58 from falling down through hole 56. Hole 56 has a greater diameter than bolt 58, allowing base 14' to move linearly relative to platform 48' and feet 52'.

In operation, this alternate embodiment is used in the same manner as the preferred embodiment, except that an operator can correct small misalignments between the tool driver 26 and the work piece by linearly moving the entire upper portion of the carriage system 10 relative to the platform 48' and feet 52', as indicated by arrows in FIG. 4.

Figure 5:
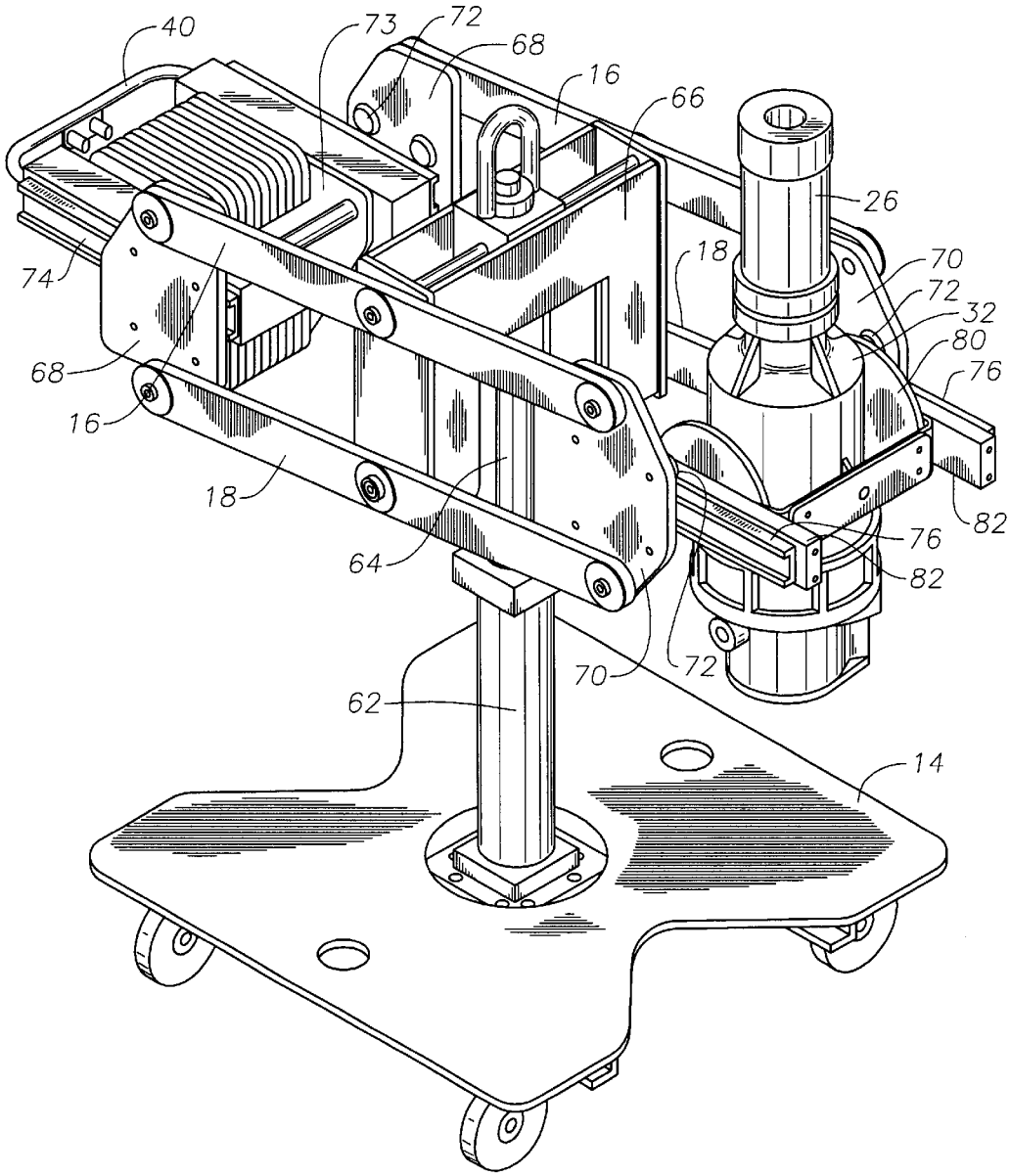
FIG. 5 is an alternate embodiment of the invention.

FIG. 5 illustrates an alternate embodiment of the carriage system of the invention. In this alternative embodiment, support member that was the vertical, cylinder pillar 12 in the other embodiment is replaced with a vertical pillar 62 and a vertical shaft 64 attached to the U-frame support structure 66 as another example of a support member. In the preferred embodiment the vertical pillar 62 uses a hydraulics system comprised of a gaseous element located over a fluid element. The hydraulics of the vertical pillar 62 permits the vertical shaft 64 to extend upward and retract downward from the vertical pillar 62 in a smooth motion. The distance the vertical shaft 64 may extend from the vertical pillar 62 is approximately 62 inches. Vertical shaft 64 is attached to the U-Frame 66 in a manner that enables the U-frame 66 to be raised and lowered by controlling the hydraulic cylinder of pillar 62 from a control mounted on handles 40.

The upper arms 16 and lower arms 18 are attached to the U-frame 66 at their midpoint with pivot pins in a vertical plane with pillar 62. The ends of the upper arms 16 and lower arms 18 is connected to track plate 68 or 70. Track plates 68 and 70 contain two sets of track running wheels 72 that will permit tracks 74 and 76 to slide freely along the horizontal plane of track plates 68 and 70.

The counterweight 28 are attached to plates 109 that are attached to tracks 74. The tracks 74 are attached to track plates 68 in a manner to allow tracks 74 to run along the track wheels 72 that are attached to track plate 68. This system permits the counterweight 28 to vary their distance from the U-frame 66 and the remainder of the carriage system.

The tool driver 26 has a body 32 that is attached to a support frame 80. The support frame 80 is with pivot pins to beams 82. The beams 82 are attached to track 76. The beams 82 permit the tool driver 26 to rotate independently of track 76(106B). Track 76 is attached to track plate 70 in a manner to allow track 76 to run along track running wheels 72 that are attached to track plate 70. This system permits the tool driver 26 to rotate independently of the U-frame and the remainder of the carriage system as well as vary the distance between the tool driver 26 and the remainder of the carriage system.

Additionally, in the embodiment illustrated in FIG. 5 portions of the carriage system can be separated from the base 14, vertical pillar 62 and vertical shaft 64, and be maneuvered into alternative positions. The U-frame 66 is attached to vertical shaft 64 through attachment bolt 84. The removal of the attachment bolt from the U-frame 66 permits the detachment of the U-frame 66, along with the attached upper arms 16, lower arms 18, counterweight 28, and tool driver 26, to be separated from the vertical shaft 64, vertical pillar 62, and base 14. The removal of the U-frame 66 from vertical shaft 64 is facilitated by lift loop 86 attached to U-frame 66. The lift loop 86 permits a crane to lift the U-frame 66 and attached structure and maneuver it into alternative positions. Additionally should the attachment bolt 84 not be removed the entire carriage system can be transported by a crane via the lift loop 86.

Further modifications and alternative embodiments of various aspects of the invention will be apparent to those skilled in the art in view of this description. Accordingly, this description is to be construed as illustrative only and is for the purpose of teaching those skilled in the art the general manner of carrying out the invention. It is to be understood that the forms of the invention shown and described herein are to be taken as the presently preferred embodiments. Elements and materials may be substituted for those illustrated and described herein, parts and processes may be reversed, and certain features of the invention may be utilized independently, all as would be apparent to one skilled in the art after having the benefit of this description of the invention. Changes may be made in the elements described herein or in the steps or in the sequence of steps of the methods described herein without departing from the spirit and the scope of the invention as described.

What is claimed is:

1. A carriage system adapted to support a driver tool, the system comprising:

at least one support member having a lower portion thereof connected to a horizontally extending platform and other portions extending upwardly therefrom;

a first arm having a medial portion thereof rotatably connected to the support member at a first elevation above the platform, a distal end of the first arm defining a first driver end and a proximal end of the first arm defining a first weight end, a distal portion of the first arm adjacent the first driver end being adapted to rotatably engage a first portion of a driver tool;

a second arm having a medial portion thereof rotatably connected to the support member at a second elevation closer to the platform than the first elevation, a distal end of the second arm defining a second driver end and a proximal end of the second arm defining a second weight end, a distal portion of the second arm adjacent the second driver end being adapted to rotatably engage a second portion of the driver tool; and a weight positioned between the first weight end of the first arm and the second weight end of the second arm, a portion of the first arm toward the first weight end is rotatably connected to an upper elevation of the weight and a portion of the second arm toward the second weight end is rotatably connected to a lower elevation of the weight, so that when the weight and the first weight end and the second weight end vertically move in combination in a first direction the first driver end and second driver end move in combination in a vertically opposite second direction.

* * * * *